United States Patent [19]

Kulesza et al.

[11] 4,279,098

[45] Jul. 21, 1981

[54] TOY AIRPLANE

[75] Inventors: Ralph J. Kulesza, Chicago, Ill.; James M. Alcock, Salt Lake City, Utah; Burton C. Meyer, Downers Grove, Ill.

[73] Assignee: Marvin Glass & Associates, Chicago, Ill.

[21] Appl. No.: 6,036

[22] Filed: Jan. 24, 1979

[51] Int. Cl.[3] ..... A63H 11/10

[52] U.S. Cl. ..... 46/101; 46/211

[58] Field of Search ..... 46/101, 106, 107, 99, 46/98, 97, 206, 204, 202, 78, 76 R, 201, 211, 103, 104, 213

[56] References Cited

U.S. PATENT DOCUMENTS

| | | | |
|---|---|---|---|
| 1,680,991 | 8/1928 | Hunter | 46/107 X |
| 1,827,775 | 10/1931 | Berger | 46/78 UX |
| 2,237,912 | 4/1941 | Palmones | 46/76 R |
| 2,419,872 | 4/1947 | Beder | 46/107 |
| 2,461,672 | 2/1949 | Adamczyk | 46/211 |
| 3,667,154 | 6/1972 | Aoki | 46/202 X |
| 3,891,130 | 6/1975 | Brennan | 273/32 D |
| 4,077,156 | 3/1978 | Asano | 46/206 |

*Primary Examiner*—G. E. McNeill
*Assistant Examiner*—Mickey Yu
*Attorney, Agent, or Firm*—Mason, Kolehmainen, Rathburn & Wyss

[57] ABSTRACT

The invention comprises a preschool toy airplane including a fuselage housing a spring motor mechanism which is wound by turning a handle located at the tail. The spring motor rotates the propeller and the winding handle relative to the fuselage of the plane body. One or more toy figures are removably positioned in or on the airplane and a cam mechanism reciprocates the toy figures within the cockpit. When the motor is wound and released, the body of the plane may be supported to simulate flight or alternatively, the handle may be supported to produce various stunts.

7 Claims, 4 Drawing Figures

TOY AIRPLANE

BACKGROUND OF THE INVENTION

1. Field of the Invention

The present invention relates to toy airplanes and in particular to devices including spring motor mechanisms and figurines mountable within the fuselage of the airplane.

2. Brief Description of the Prior Art

Toy airplanes have been provided in many forms because of their ability to maintain the interest of a user as well as providing certain vicarious experiences such as daredevil stunts and the like. In addition, in the hobby field, model airplanes have been provided in a form in which the plane was controlled by a tethering line or remotely controlled by radio. Examples of these latter types are shown in U.S. Pat. Nos. 1,728,245 and 1,580,833.

In addition, hand-held toy planes have been provided such as that shown in U.S. Pat. No. 4,033,070. These latter types provide the excitement and thrill of flying as the child imagines himself in the cockpit of an airplane performing the enumerable maneuvers which are simulated by his direction of the toy airplane through the air. The present invention provides a new and entertaining toy airplane of the hand-held variety which includes additional features and effects unknown in the prior art.

SUMMARY OF THE INVENTION

The present invention is a preschool toy in the form of a hand-held toy airplane. The plane includes a fuselage housing, a propeller on one end and a rotatable winding handle at the other end. The fuselage houses a spring motor mechanism which is wcund by turning the handle which causes rotation of the propeller mounted on the same shaft. One or more toy figures are removably positionable on or in the plane and may be inserted into apertures located in the center of the fuselage protuberances located on the wings of the airplane providing means to mount the figures on the wings for performing stunts.

It is an important object of the present invention to provide a new and improved toy airplane which will provide hours of entertainment and at the same time, educate the child as to the parts and functions of a plane.

DESCRIPTION OF THE PREFERRED EMBODIMENT

Figure 1:
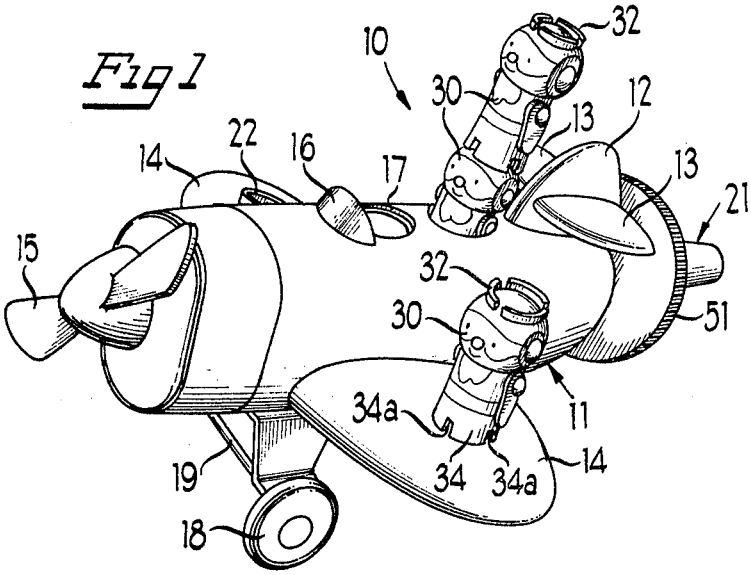
FIG. 1 is a perspective view of a toy vehicle embodying the concepts of the present invention.

The toy plane, generally designated 10, of the present invention includes a fuselage 11 having a tail section 12, rear wings 13 affixed to the tail section 12, support wings 14, and a propeller 15. A pair of wheels 18 are rotatably mounted by an axle 19 which is connected to the fuselage of a landing gear. The top of the fuselage 11 includes a pair of apertures 17 as the front and rear cockpit of an airplane. A windshield or visor 16 is provided in front of the front cockpit 17 to impart a realistic appearance to the airplane.

Figure 2:
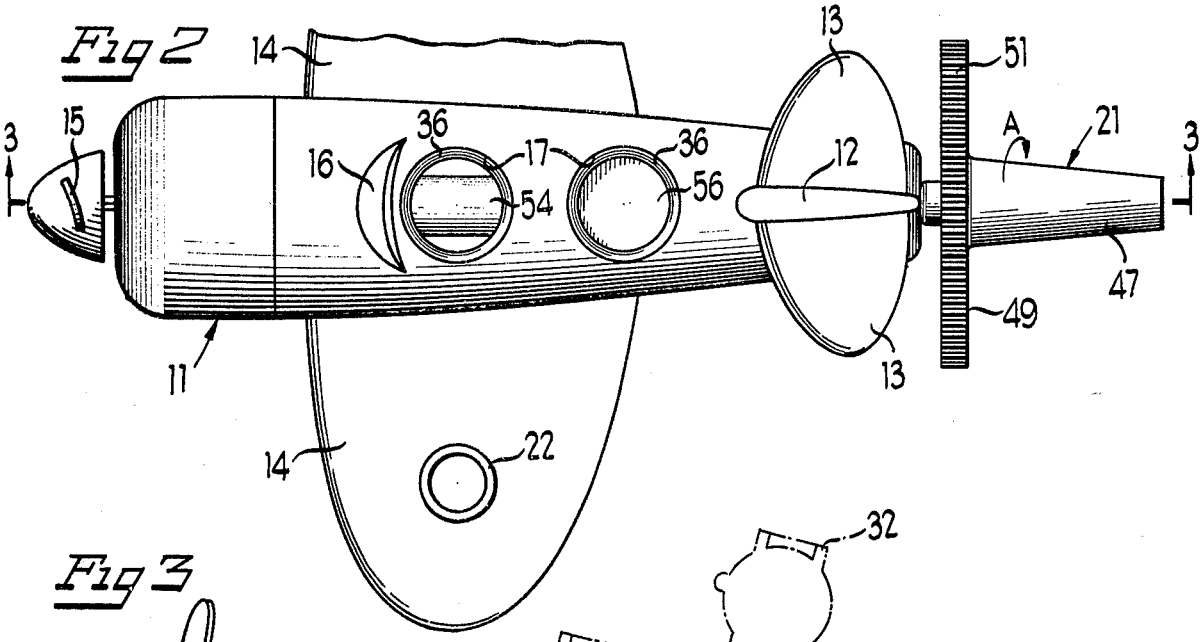
FIG. 2 is a partial plan view of the airplane of FIG. 1.
Figure 3:
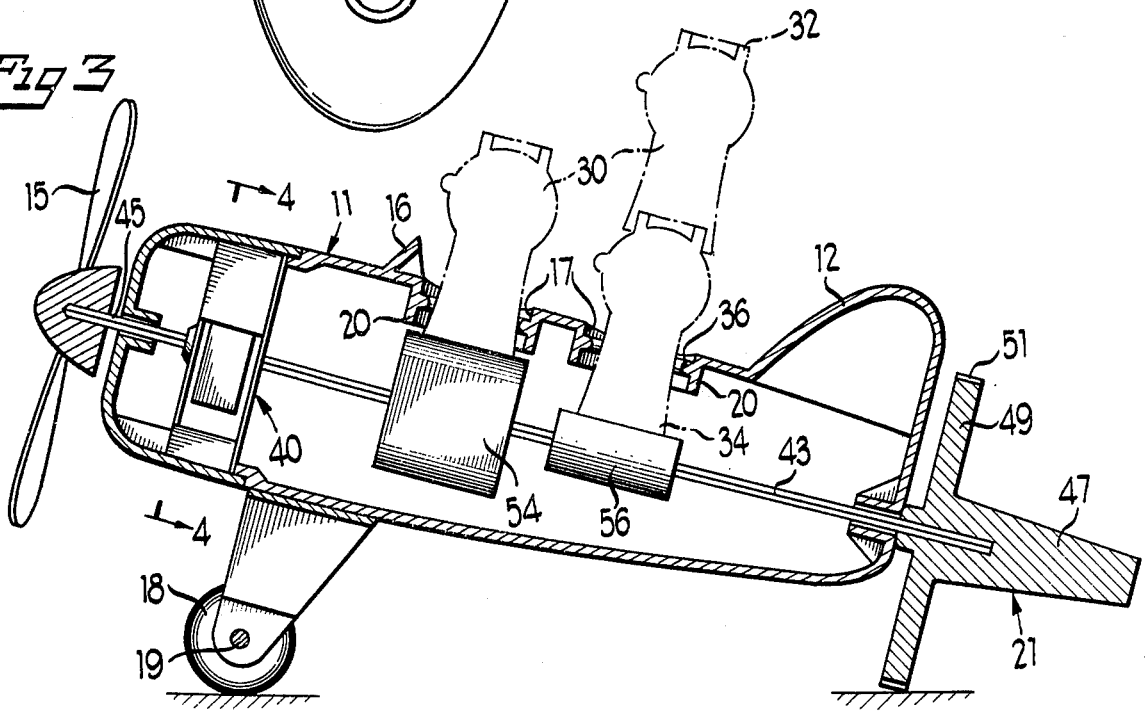
FIG. 3 is a vertical sectional view taken generally along line 3—3 of FIG. 2.

The invention includes a plurality of toy figures 30 which are formed and decorated to appear as miniature aviators having headsets, goggles and the like. Each of the toy figures includes a lower skirt portion 34 which is flared slightly outwardly and is provided with a plurality of slots 34*a* which permit the flared skirt to be compressed slightly for use as will be described in greater detail below. On the top of the head portion of each toy figure, a upwardly extending annular ring 32 provides means for interconnecting the toy figures as shown in FIGS. 1 and 2. Each of the rings 32 includes a plurality of slots, similar to the skirt to provide some flexibility and to add to the appearance of the toy figure. The outside diameter of the rings 32 are slightly larger than the inside diameter of the flanged skirts 34 so that the toy figures may be stacked upon one another by snapping a skirt 34 of one toy figure onto the top of the ring 32 of another toy figure. The frictional engagement between the toy figures will maintain the stacked relationship as shown in FIGS. 1 and 3.

Each of the apertures 17 is defined by a generally depending circular flange 20 and each includes an inward protrusion in the form of a ridge 36. The internal diameter of the ridges 36 are slightly smaller than the maximum diameter of the flared skirts 34 so that the toy figures 30 may be snapped into the apertures 17, past the ridges 36, to be maintained therein until a sufficient force is applied upon withdrawing a toy figure to flex the skirt past the ridge 36. This structure permits the toy airplane 30 to be flown in an upside down orientation while holding the toy figures within the cockpit 17.

In order to provide additional entertainment, additional structural features are provided on the wings to permit certain stunts and other feats to be performed. For example, each of the wings 14 includes an annular ring 22 which protrudes upwardly in a manner similar to the rings 32 on each of the figures. The toy figures can therefore be removably secured on the top of the wings 14 as shown on the left wing in FIG. 1.

Figure 4:
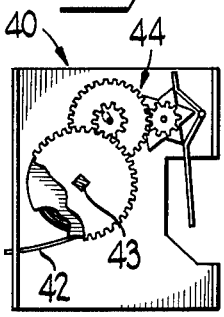
FIG. 4 is another vertical section taken generally along line 4—4 of FIG. 3.

A drive means in the form of a spring motor 40 is provided to rotate the propeller 15 and perform additional functions as described hereinafter. The spring drive mechanism as shown in FIGS. 3 and 4 to include a generally elongated square shaft 43 which extends to an opening in the rear of the fuselage for rotatably mounting the handle 21. A propeller shaft 45, which may be integral with the shaft 43, extends through a similar flanged aperture in the front wall of the fuselage for rotatably mounting the propeller 15 thereon. The winding handle 21 includes a generally conically shaped hub portion 47 and a large disc portion 49 which includes a serrated or toothed periphery 51. The spring motor can be easily wound in the direction shown by arrow A in FIG. 2 by grasping the hub 47 between the thumb and forefinger and rotating the handle as shown. The square shaft 43 is connected to the output gear of a typical Aladdin spring motor in which energy is stored in a spring element 42. A gear train, generally designated 44, through a starwheel-type release mechanism governs the speed of the output shaft 43 so that it is substantially slow and therefore safe for use by a child of any age.

As can be seen in FIG. 3, a pair of generally double lobed, generally oblong cams 54 and 56 are conjointly rotatably mounted on the shaft 43, generally in a position adjacent each of the cockpit apertures 17. In a normal, upright position as shown in FIG. 3, when the toy figures are placed within the cockpits 17, they will come to rest, by gravity, on the surfaces of the cams 54 and 56 and be supported thereby. The cams 54 and 56 are secured to the shaft 43 in a position such that the cams are 90° out of phase with one another and, as the shaft 43 is turned under the influence of the spring motor 40, the figures 30 within the respective apertures will reciprocate from an uppermost position as shown in the front cockpit in FIG. 3 to a lowermost position as shown in the rear cockpit of FIG. 3.

A user may therefore wind the spring motor and fly the airplane by hand, through the air, as the propeller rotates at a relatively slow rate of speed. As described above, the figures within the cockpits will reciprocate due to the cam mechanism. Alternatively, the user may grasp the hub portion 47 of the handle which then causes the airplane to rotate relative thereto simulating a stunt plane rotating or going into a spin. In this latter use, toy figures 30 positioned on the wing protrusions 22 will appear as daredevil aviators. In another manner of operation, the plane 10 may be placed on a supporting surface, as shown in FIG. 3, so that upon release of the handle 21, after winding the spring motor, the serrated edge 51 will cause the plane to generally rotate about the support provided by the front wheels 18. Thus, it can be seen that the plane of the present disclosure, including many modifications obvious to those skilled in the art, can provide many hours of entertainment for the user as well as assisting and educating a child as to the elements and operation of an airplane.

The foregoing detailed description has been given for clearness of understanding only and no unnecessary limitations should be understood therefrom as some modifications will be obvious to those skilled in the art.

I claim:

1. A toy airplane selectively capable of aerial barrel rolling and random taxi maneuvers comprising:

a fuselage;

a propeller rotatably mounted on the front of said fuselage;

a hand graspable handle rotatably mounted on the rear of said fuselage;

three wheels connected to said fuselage for supporting said fuselage on a surface, two of said wheels mounted on said fuselage side by side for rotation around an axis generally transverse to the length of said fuselage, said third wheel mounted on said fuselage spaced from said side by side wheels for rotation around an axis extending generally parallel to the length of said fuselage;

barrel rolling means for simultaneously rotating said propeller and said fuselage around an axis extending generally parallel to the length of said fuselage when said fuselage is supported by said handle;

random taxi means for simultaneously rotating said propeller around said axis extending along the length of said fuselage and said fuselage around an upstanding axis through said side by side wheels generally perpendicular to the length of said fuselage, when said fuselage is supported on a surface by said wheels;

drive means mounted within said fuselage and connected to said propeller for rotating the same; and winding means for winding said drive means.

2. The toy airplane of claim 1 including at least one toy figure mountable on the toy airplane and cam means associated with the drive means for movement of the toy figure relative to the airplane in response to said drive means.

3. The toy airplane of claim 2 wherein said cam means comprises at least one cam rotatably mounted by a shaft drivingly connected to said drive means.

4. The toy airplane of claim 3 wherein said fuselage includes at least one cockpit, generally in alignment with said at least one cam for receiving said toy figure and supporting the same in engagement with said cam.

5. The toy airplane of claim 4 including means for frictionally retaining said toy figure within the cockpit.

6. The toy airplane of claim 5 wherein said toy figure includes at least a deformable portion and said cockpit includes restriction means generally smaller than said deformable portion for retaining the toy figure therein.

7. The toy airplane of claim 6 including means for frictionally mounting at least one of the toy figures on one of the wings of the airplane.

* * * * *